United States Patent [19]

Landheer

[11] Patent Number: 4,918,895

[45] Date of Patent: Apr. 24, 1990

[54] SANDWICH WALL SYSTEM PANEL

[75] Inventor: Hugo A. Landheer, Spijkenisse, Netherlands

[73] Assignee: Hunter Douglas International N.V., Curacao, Netherlands

[21] Appl. No.: 295,960

[22] Filed: Jan. 11, 1989

[30] Foreign Application Priority Data

Jan. 11, 1988 [GB] United Kingdom ..... 8800504

[51] Int. Cl.[5] ..... E04C 1/10

[52] U.S. Cl. ..... 52/580; 52/309.11; 52/595

[58] Field of Search ..... 52/580, 588, 595, 309.11, 52/478, 593

[56] References Cited

U.S. PATENT DOCUMENTS

| | | | |
|---|---|---|---|
| 3,372,520 | 3/1968 | Hensel | 52/595 X |
| 3,760,548 | 9/1973 | Sauer et al. | 52/309.11 X |
| 4,186,539 | 2/1980 | Harmon et al. | 52/580 |
| 4,198,951 | 4/1980 | Ellison et al. | 52/580 X |
| 4,236,366 | 12/1980 | Rijinders | 52/580 |
| 4,360,553 | 11/1982 | Landheer | 52/595 X |

*Primary Examiner*—Carl D. Friedman

*Attorney, Agent, or Firm*—Pennie & Edmonds

[57] ABSTRACT

A sandwich wall system panel comprising an insulating core (18), a first metal skin (14) adhered to one face of the core, a second metal skin (16) adhered to the opposite face of the core, a rim portion (36,38) associated with and extending along one longitudinal edge of each of said first and second metal skins, said rim portions facing one another, the free ends of said rims portions extending in parallel spaced relation to one another, to define a central joining tongue flanked by a pair of channels (100,102) and extending from the longitudinal edge of the panel, a pair of spaced parallel legs (76,78) formed by marginal portions of said first and second skins (14,16) and projecting beyond the core (18) at the opposite longitudinal edge of the panel, said legs (76,78) being spaced to form a groove to receive the tongue of an adjacent, similar panel, the legs then being accommodated within the channels of the adjacent panel, and at least one rigid connector (62), inserted between said rim portions (36,38) connecting said tongue forming free ends to prevent movement of said rim portions towards and away from one another.

10 Claims, 3 Drawing Sheets

SANDWICH WALL SYSTEM PANEL

The present invention relates to a sandwich wall system panel.

Conventionally such panels are formed with an insulating core sandwiched between first and second metal skins. This is usually effected by injecting a foaming compound in between the first and second metal skins and allowing the compound to foam and cure. The opposite edge portions are usually provided with a tongue and groove arrangement to enable adjacent panels to be interconnected. To provide adequate rigidity at least one of the opposite edge portions is usually provided with a continuous connecting profile or member extending between the first and second skins. One of the problems associated with such panels is that the connecting profile could form a heat bridge diminishing the insulating effect of the core. In order that a satisfactory level of thermal insulation is attained the choice of material for the connecting profile is limited. This limitation in choice also affects the ability of the connecting profile to transmit forces exerted on the outer skin to the supporting structure at the inner side of the panel, since the known materials which offer sufficient thermal insulation are lacking in mechanical strength. This problem is further aggravated if mechanical strength is required over an extended temperature range such as would be the case for fire retardant or fire resistant panels. A further problem with the above described panels is that the connecting profile is mounted prior to formation of the core and is then fixed in position by the foam core. Due to this fact it is not possible to replace a connecting profile or to exchange it for a different type adapted for a particular application, once the sandwich has been formed.

It is now proposed, according to the present invention, to provide a sandwich wall system comprising an insulating core, a first metal skin adhered to one face of the core, a second metal skin adhered to the opposite face of the core, a rim portion associated with and extending along one longitudinal edge of each of said first and second metal skins, said rim portions facing one another, the free ends of said rims portions extending in parallel spaced relation to one another, to define a central joining tongue flanked by a pair of channels and extending from the longitudinal edge of the panel, a pair of spaced parallel legs formed by marginal portions of said first and second skins and projecting beyond the core at the opposite longitudinal edge of the panel, said legs being spaced to form a groove to receive the tongue of an adjacent, similar panel, the legs then being accommodated within the channels of the adjacent panel, and at least one rigid connector, inserted between said rim portions and connecting said tongue-forming free ends to prevent movement of said rim portions towards and away from one another.

The sandwich panels themselves can be formed relatively easily and the required strength can be provided by inserting the rigid connector or connectors between the rim portions on site.

The tongue-forming free end is connected by at least a single connector, but is preferably connected by a plurality of longitudinally spaced relatively short connectors.

Such a construction can overcome this problem because the connectors can be relatively short, in the longitudinal sense of the panel, and can be longitudinally spaced from one another, so that their ability to transmit heat is greatly reduced as compared with a construction in which the connection between the metal skins is continuous along the full length of the panel. An adequate mechanical strength can be provided by the longitudinally spaced connectors and yet only a very small thermal transmission is caused thereby. The rigid connectors can in particular be provided at the specific locations where mounting brackets are located in the channels, to increase the strength at these locations.

With the construction of the present invention, the first and second metal skins are each adhered to opposite faces of the core by a suitable adhesive. This can be effected by initially forming a substantially rigid block of insulating core material and adhering the first and second skins thereto subsequently. The actual sequence could be: skin extensions or rim portions fixed to skins, after which the sandwich is formed by successively superimposing, a first skin, glue or adhesive, mineral core, glue or adhesive and the second skin. At a final stage the required number of connectors can then be inserted and will snap-fit in position.

Alternatively the following manufacturing sequence would also be possible: interconnecting two separately formed rim portions in the form of joining members by the required number of connectors then inserting the thus obtained pre-assembly into a first skin, onto which the core is glued and finally hooking and gluing the last skin onto said assembly.

The construction of the present invention has the further advantage in that instead of the more normal conventional PVC material used for the panel connectors, one can use metal connectors which would otherwise have too great a heat transmission characteristic, this being overcome, as explained above, by the relatively short lengths of the connectors as compared with the full length of the panel.

In a preferred construction, the rim portion comprises a separate elongate, generally U-shaped joining member, including a short arm of the U engaged in an associated inturned rim of the first and second skin and a longer arm, the two longer arms extending in parallel spaced relation and forming said free ends of said rim portions defining a central joining tongue, said at least one connector engaging the joining members of a pair to prevent movement of the joining members towards and away from one another.

With such a construction, the joining members advantageously each include an elongate rib extending parallel to said arms, on the side of said longer arm remote from said short arm, to define a groove, said at least one connector including a pair of spaced projections extending into said groove to provide the engagement between the connector and the joining members.

This provides a simple reliable connection between the joining members and the connectors.

In order to strengthen the assembly, preferably the longer arms are provided with inturned beads and said at least one connector includes a pair of spaced flanges, shaped to engage said beads, to make the longer arms still more rigid and to additionally hold the connectors in position.

To provide even further rigidity, the connector or connectors may include at least one web extending between the flanges. Advantageously the flanges diverge away from the projections and the grooves defining elongate ribs at the inner ends of the longer arms are spaced from each other by an amount less than the inturned beads, to enable easy snap fit insertion of the projections into the channels.

In an alternative construction, each connector may comprise a clip which engages over the interior of the inturned rim or over the exterior of the longer arms of the pair of joining members, where provided. In this case the connector may include lugs which are forced into the edge of the core to provide a further grip.

The core may include a portion spaced between the free ends of the rim portions to improve insulation across the central joining tongue. In order that the present invention may more readily be understood, the following description is given, merely by way of example, reference being made to the accompanying drawings in which.

Figure 1:
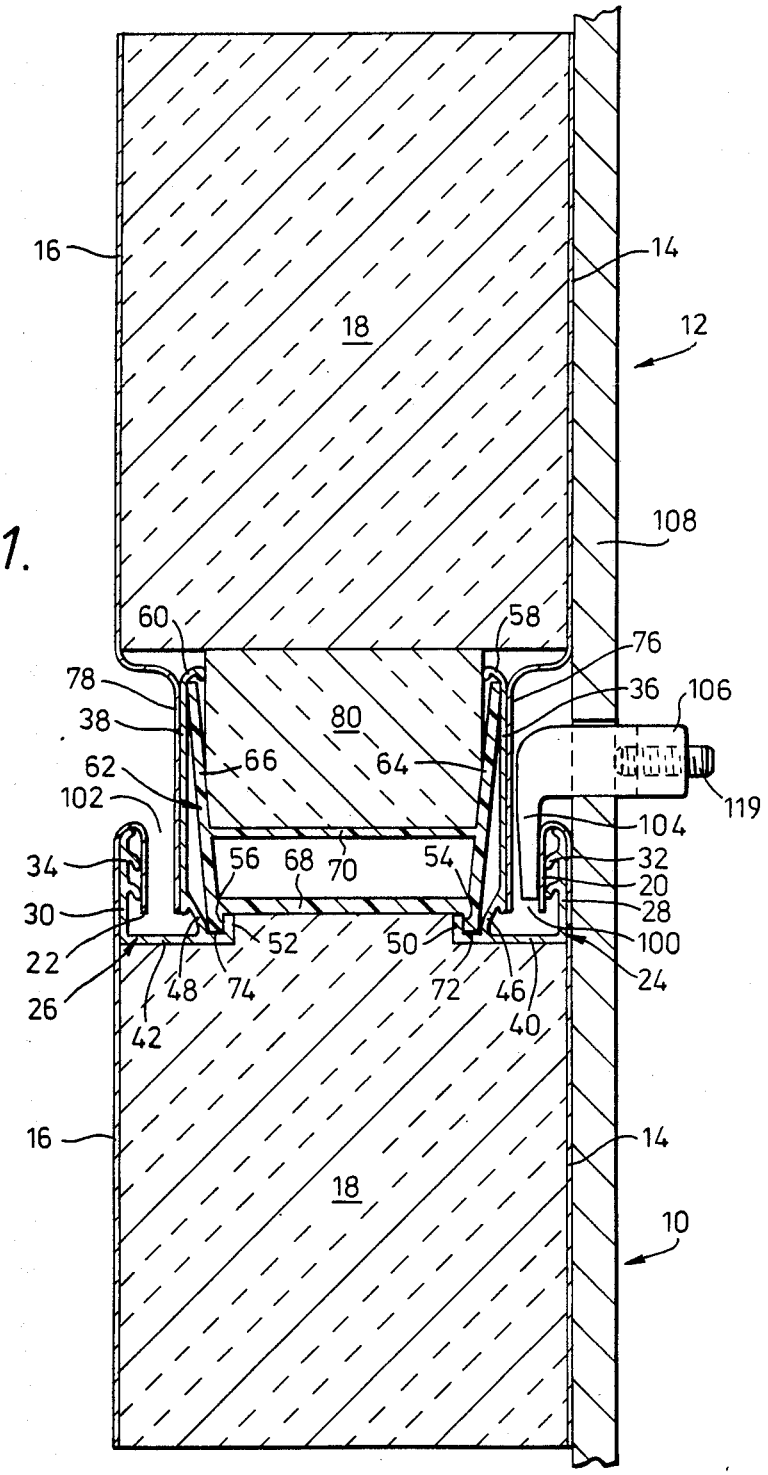
FIG. 1 is a schematic cross section through the upper portion of one panel and the lower portion of another panel constructed in accordance with one embodiment of the present invention.
Figure 2:
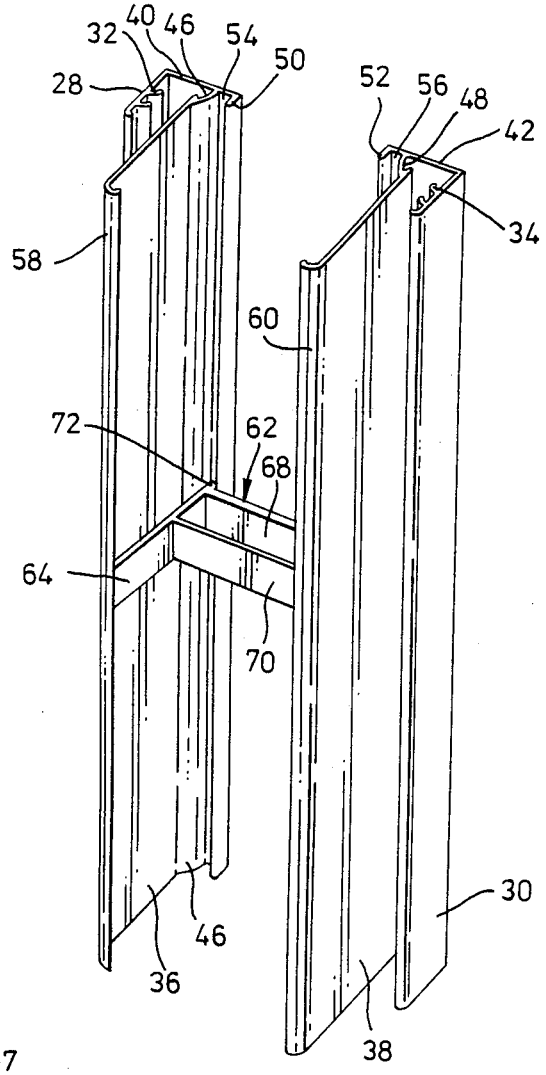
FIG. 2 is a perspective view showing the two joining members of one of the panels of FIG. 1 being held together by a connector.
Figure 3:
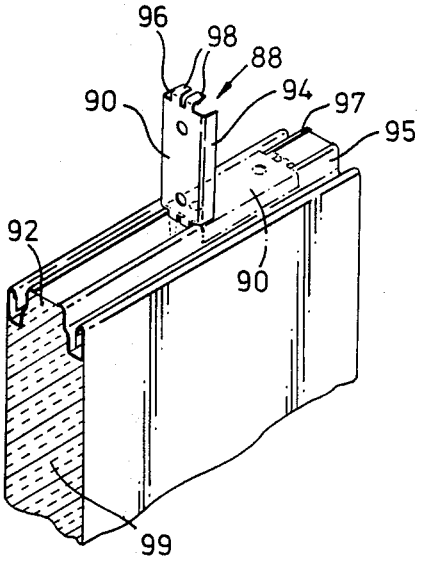
Figure 4:
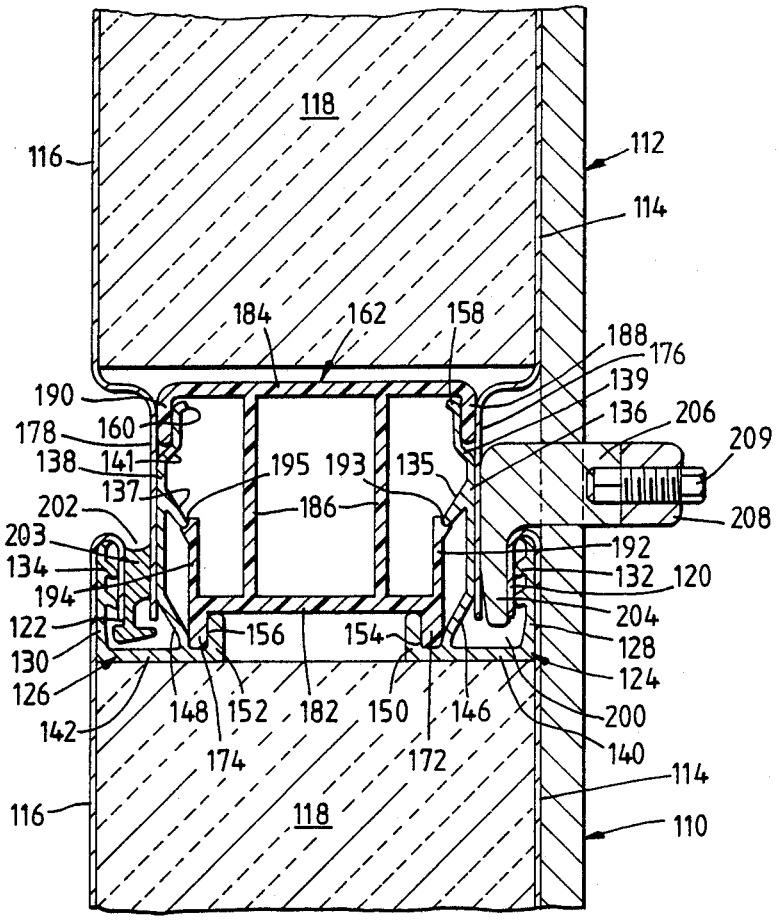

FIG. 3 is a perspective view, to a much reduced scale, schematically illustrating a different form of connector used in constructing a second embodiment of panel according to the invention; and FIG. 4 is a view similar to FIG. 1 showing a second embodiment. Referring first to FIG. 1 and 2, a lower panel indicated by the general reference numeral 10 is mounted immediately below an upper panel indicated by the general reference numeral 12. The two panels are substantially identical and have, as will be explained later, a tongue and groove arrangement interconnecting the longitudinal upper and lower ends of said two panels.

Each panel comprises a first metal skin 14 and a second metal skin 16 parallel thereto, with an insulating core 18 adhered to the inner faces of the first and second skins 14, 16.

The first and second skins 14, 16 have inturned beads 20, 22, extending along their upper longitudinal edges, which are positioned in parallel spaced relationship and facing one another.

Mounted adjacent these beads 20, 22 are two substantially identical joining members 24, 26 arranged in mirror image relationship to one another. These joining members are separate and elongate members of a generally U-shaped configuration having a shorter arm 28, 30 respectively, provided with longitudinally extending fingers 32, 34 which engage snugly within the inturned rim portions 20, 22.

Each joining member also has a longer arm 36, 38, the two longer arms again extending substantially parallel to one another and being joined to the shorter arms 20, 22 by web portions 40, 42. At the point where they join the web portions 40, 42 the longer arms are inclined inwardly as shown at 46, 48. A further rib 50, 52 is provided on each joining member and this defines, with the portions 46, 48, a groove 54, 56. The longer arms 36, 38 form rim portions associated with and effectively extending along one longitudinal edge of each of said first and second metal skins 14, 16, the rim portions facing one another, the free ends of the rim portions extending in parallel spaced relation to one another, to define a central joining tongue flanked by a pair of channels 100, 102. The free ends of the longer arms are shown as provided with detent portions in the form of inturned beads 58, 60.

Associated with the two joining members are a number of longitudinally spaced metal connectors 62, these each including a pair of spaced flanges 64, 66 which diverge away from one another and are joined by at least one, and as shown, two, webs 68, 70. The lower web illustrated in FIG. 1 is spaced from the lower ends of the arms 64, 66, to provide downwardly extending projections 72, 74 which are dimensioned to fit snugly into the grooves 54, 56.

Assuming that the upper panel is not in the position illustrated, the connector can be inserted between the longer arms 36, 38, simply by pushing downwardly between the beads 58, 60 which will flex outwardly to allow this. Because the connectors are formed by the two divergent flanges, the narrower end (the lower end) of the connector can readily be inserted between the beads 58, 60 and this shape also assists in centering the projections 72, 74 as they slide over the inclined portions 46, 48, to guide the projections into the grooves 54, 56. As this guiding takes place, the beads 58, 60 snap over the tops of the member arms 64, 66 and act as retaining detents.

The lower ends of the first and second skins 14, 16 are offset inwardly to form, at the marginal portion of these skins, a pair of spaced parallel legs 76, 78 which define a groove. The dimensioning of the groove is such as snugly to co-operate with the tongue formed by the longer arms 36, 38 of the joining members 24, 26.

A further portion of the core has been indicated at 80 and this can be inserted above the web 70 to provide for further insulation.

FIG. 2 illustrates well how the connector 62 only extends over a short proportion of the total length of the panel, so that while it provides the necessary rigidity, it provides a very small thermal bridge.

An alternative construction is illustrated in FIG. 3 in which, instead of having the connector as the connector 62 of FIGS. 1 and 2, extending within the tongue, a connector 90 engages over the outer surfaces of the tongue 92, the connector 90 having downturned parts 94, 96 which engage over the exterior of the longer arms 95, 97 of the tongue 92. As shown, the connector 90 also includes four lugs 98 which can be forced into the core material 99. This is a very simple, but probably less robust construction of FIGS. 1 and 2.

While in FIGS. 1 and 2 the tongue has been shown as formed by the separate joining members 24, 26, the front and rear skins 14, 16 could themselves be shaped to form integral tongue forming walls similar to the longer arms 36, 38. It would be necessary, however, to ensure that there are channels similar to the channels 100, 102. The purpose of these channels is to receive an arm 104 of a bracket 106 which is used to support the panels against a support member 108. The bracket 106 is shown as being provided with a securing screw 109.

Referring now to FIG. 4 a modified construction is illustrated in which like parts are indicated by like reference numerals with the addition of 100. It will be noted that the lower panel 110 and the upper panel 112 are substantially identical to the panels 10 and 12 and further description of these is not thought to be necessary. Again the joining members 124, 126 are very similar and only the minor changes will be noted. It will be seen that the longer arms 136, 138 have associated therewith downwardly extending detent portions in the form of inclined fingers 135, 137 and that the upper parts of the longer arms are cranked at 139 and 141 so that the inturned beads 158, 160 are rather closer to one another than in the construction of FIGS. 1 and 2.

In the construction of FIG. 4 the longitudinally spaced metal connectors 162 are of a different construction being a box section including lower and upper plates 182, 184 and two vertically extending webs 186. The upper plate 184 is provided with downturned rims 188, 190. The lower plate 182 is provided with downwardly extending projections 172, 174, similar to those of the FIG. 1 and 2 construction; it is also provided with upwardly extending arms 192, 194 provided with forwardly and outwardly opening recesses 193, 195 at their upper free ends.

The assembly is carried out in much the same way as previously, the downwardly extending projection 172, 174 being slid over the inclined portion 146, 148 to guide the projection into the grooves 154, 156. As this guiding takes place, the beads 158, 160 slide into the cavity formed between the rims 188, 190. At the same time the lower ends of the fingers 135, 137 engage in the recesses 193, 195 in the outwardly extending arms 192, 194.

As before, the channel 200 receives an arm 204 of a bracket 206 which is used to support the panels against the support member 208, the bracket 206 being provided with a securing screw 209. A sealing member 203 is inserted in the other channel 202.

This modified design enables one more readily to attach the connectors at the building site. It has been found that the rigidity of the installed panels can be greatly improved if the position of the connectors corresponds exactly to the position of the brackets to which the panels are attached to the building structure. Since the exact position will not be known until the panels are actually installed, it is necessary to allow for an easy and secure snap-fit at the building site which is possible with the construction of FIG. 4.

I claim:

1. A sandwich wall system panel comprising an insulating core, a first metal skin adhered to one face of the core, a second metal skin adhered to the opposite face of the core, first and second longitudinal edges of each of said first and second metal skins being arranged at opposite longitudinal edges of the panel, a rim portion associated with and extending along the first longitudinal edge of each of said first and second metal skins, said rim portions facing one another, the free ends of said rim portions extending in parallel spaced relation to one another, effective to define a central joining tongue extending from one longitudinal edge of the panel, a pair of spaced parallel legs, one extending along said second longitudinal edge of each of said first and second skins and projecting beyond the core said legs being spaced to form a groove to receive the central joining tongue formed by the rim portions of an adjacent, similar panel, and at least one separate rigid connector, inserted between and connecting said tongue—forming free ends of said rim portions to said spaced parallel legs to prevent movement of said rim portions towards and away from one another.

2. A panel according to claim 1, wherein said first and second rim portions each include an inturned bead each retaining a separate elongate, generally U-shaped joining member, including a short arm of the U engaged in the associated inturned bead of the first and second rim portions and a longer joining arm, the two longer arms extending in parallel spaced relation inwardly of said shortarms and defining said central joining tongue, said at least one connector engaging the joining members to prevent movement of the joining members towards and away from one another.

3. A panel according to claim 2, wherein the joining members each include an elongate rib extending parallel to said arms, on the side of said longer arm remote from said short arm, to define a groove, said at least one connector including a pair of spaced projections extending into said groove to provide the engagement between the connector and the joining members.

4. A panel according to claim 1 or 2, wherein the longer arms further comprise detent portions and wherein said at least one connector includes a pair of spaced flanges, shaped to engage said detent portions.

5. A panel according to claim 4 wherein said tongue forming free ends are connected by a plurality of longitudinally spaced connectors.

6. A panel according to claim 4 wherein said at least one connector further comprises at least one web extending between said flanges.

7. A panel according to claim 4, wherein said flanges diverge away from said projections and wherein the groove defining elongate ribs at the inner ends of the longer arms are spaced from each other by an amount less than the detent portions to enable a snap-fit insertion of the connection between said longer arms.

8. A panel according to claim 1, wherein said at least one connector comprises a clip engaging over the exterior of the rim portions or over the exterior of the longer arms of the pair of joining members.

9. A panel according to claim 8, wherein the clip further comprises lugs forced into the edge of the core between said rim portions.

10. A panel according to claim 1, wherein said core includes a portion positioned between the free ends of said rim portions to improve insulation across the central joining tongue.

* * * * *

UNITED STATES PATENT AND TRADEMARK OFFICE

CERTIFICATE OF CORRECTION

PATENT NO. : 4,918,895

DATED : April 24, 1990

INVENTOR(S) : Hugo Arie Johan Landheer

It is certified that error appears in the above-identified patent and that said Letters Patent is hereby corrected as shown below:

ON TITLE PAGE:

Change the inventor's name from "Hugo A. Landheer" to --Hugo A.J. Landheer--.

Change the Assignee's address from "Curacao, Netherlands" to --Curacao, Netherlands Antilles--.

Signed and Sealed this

Thirteenth Day of August, 1991

*Attest:*

*Attesting Officer*

HARRY F. MANBECK, JR.

*Commissioner of Patents and Trademarks*